US007918213B2

(12) United States Patent
Althof et al.

(10) Patent No.: US 7,918,213 B2
(45) Date of Patent: Apr. 5, 2011

(54) CONTROL METHOD FOR AN INTERNAL COMBUSTION ENGINE

(75) Inventors: Andreas Althof, Dortmund (DE); Stefan Fuehling, Wetter (DE); Wolfgang Mai, Eschborn (DE); Knut Meyer, Essen (DE); Jens Pache, Schwalbach a. Ts. (DE); Matthias Wiese, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 538 days.

(21) Appl. No.: 12/046,156

(22) Filed: Mar. 11, 2008

(65) Prior Publication Data

US 2008/0236551 A1 Oct. 2, 2008

(30) Foreign Application Priority Data

Mar. 23, 2007 (DE) ..... 10 2007 013 993

(51) Int. Cl.
*F02M 33/02* (2006.01)

(52) U.S. Cl. ..... 123/520

(58) Field of Classification Search ..... 123/518–521
See application file for complete search history.

(56) References Cited

U.S. PATENT DOCUMENTS

| | | | | |
|---|---|---|---|---|
| 5,606,955 | A * | 3/1997 | Yuda | 123/520 |
| 5,988,150 | A * | 11/1999 | Osanai | 123/520 |
| 7,775,195 | B2 * | 8/2010 | Schondorf et al. | 123/520 |
| 2003/0183206 | A1 * | 10/2003 | Fujimoto et al. | 123/520 |
| 2005/0284445 | A1 * | 12/2005 | Ozaki et al. | 123/325 |
| 2007/0277789 | A1 * | 12/2007 | Ishikawa et al. | 123/520 |

FOREIGN PATENT DOCUMENTS

DE 10126520 5/2001

* cited by examiner

*Primary Examiner* — Stephen K Cronin
*Assistant Examiner* — Arnold Castro
(74) *Attorney, Agent, or Firm* — King & Spalding L.L.P.

(57) ABSTRACT

In a control method for an internal combustion engine (1) which has a fuel tank (18), a fuel vapor storage device (25) for storing the escaping fuel vapors and a controllable valve (28) for adjusting the stream of fuel vapors fed to the intake tract (4) during a period of tank ventilation, the valve (28) is controlled in such a way according to the method that the stream of fuel vapors varies during the tank ventilation period. The regeneration of the fuel vapor storage device is intended to be improved thereby.

8 Claims, 2 Drawing Sheets

CONTROL METHOD FOR AN INTERNAL COMBUSTION ENGINE

CROSS-REFERENCE TO RELATED APPLICATIONS

This application claims priority to German Patent Application Number 10 2007 013 993.6 filed on Mar. 23, 2007, and which is incorporated herein by reference in its entirety.

TECHNICAL FIELD

The invention relates to a control method for a combustion engine and to a combustion engine having a control device by means of which the control method can be executed.

BACKGROUND

Modern motor vehicles currently normally possess a tank ventilation system. In such a system the fuel vapors generated in the fuel tank of the motor vehicle are adsorbed into an active charcoal container. The active charcoal container is connected to the intake tract of the internal combustion engine via a ventilation duct. In the ventilation duct is a tank ventilation valve by means of which the active charcoal container can be connected to or separated from the intake tract, as desired. From time to time the active charcoal container loaded with fuel vapors must be regenerated. To this end, the tank ventilation valve is opened and the adsorbed fuel vapors flow from the active charcoal container into the intake tract and participate in the combustion process of the internal combustion engine. During the regeneration process the active charcoal container is purged by a constant purge stream. However, in this known process the active charcoal container is not optimally regenerated and as a result its adsorption capacity is only partially utilized. The regeneration process must therefore be performed very frequently, which, depending on the operating state of the internal combustion engine, is not always possible.

SUMMARY

According to an embodiment, a method for controlling an internal combustion engine, wherein a fuel vapor storage device is connected to a fuel tank via a connection pipe for the purpose of storing the fuel vapors escaping therefrom, as well as to an intake tract of the internal combustion engine, via a ventilation duct, for the purpose of introducing the stored fuel vapors into the intake tract during a period of tank ventilation, and wherein a controllable valve for adjusting the stream of fuel vapors fed to the intake tract is provided, may comprise the step of controlling the valve in such a way that the stream of fuel vapors varies during the tank ventilation period.

According to another embodiment, an internal combustion engine may comprise a fuel tank, a fuel vapor storage device, which is connected to the fuel tank via a connection pipe for the purpose of storing the fuel vapors escaping therefrom, as well as to an intake tract of the internal combustion engine, via a ventilation duct, for the purpose of introducing the stored fuel vapors into the intake tract during a period of tank ventilation, a controllable valve for adjusting the stream of fuel vapors fed to the intake tract, and a control device, which is connected to the valve and which controls the valve in such a way that the stream of fuel vapors varies during the tank ventilation period.

According to a further embodiment the valve may be controlled in such a way that the stream of fuel vapors is reduced and increased again several times during the tank ventilation period. According to a further embodiment, the valve may be controlled in such a way that the stream of fuel vapors is reduced until it is completely interrupted. According to a further embodiment the valve may be controlled in such a way that the stream of fuel vapors is increased to a predefined target stream at the beginning of the tank ventilation period and the stream of fuel vapors is not varied until the target stream has been reached. According to a further embodiment, a degree of loading of the fuel vapor storage device may be determined, and the period during which the stream of fuel vapors is reduced may be determined as a function of the degree of loading. According to a further embodiment, a degree of loading of the fuel vapor storage device may be determined, and the period during which the stream of fuel vapors is reduced may be determined as a function of the maximum stream of fuel vapors. According to a further embodiment, the valve may be a tank ventilation valve that is arranged in the ventilation duct between the fuel vapor storage device and the intake tract.

BRIEF DESCRIPTION OF THE DRAWINGS

The invention is described in more detail below with reference to an exemplary embodiment illustrated in the attached figures, in which.

DETAILED DESCRIPTION

Figure 1:
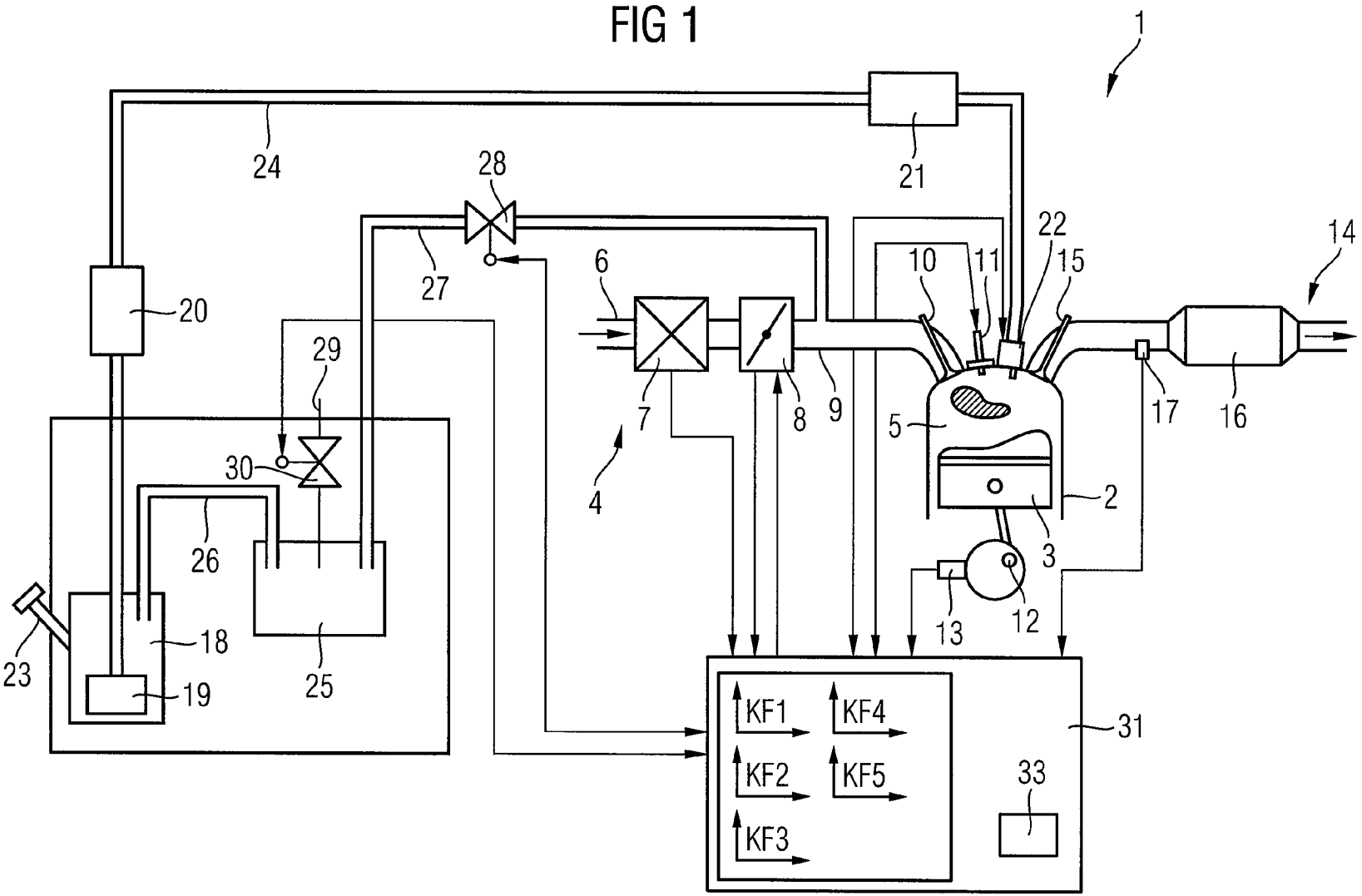
FIG. 1 shows a schematic representation of an internal combustion engine.

As stated above, a control method according to an embodiment relates to an internal combustion engine with a fuel tank and a fuel vapor storage device that is connected to the fuel tank via a ventilation duct for the purpose of storing the fuel vapors escaping therefrom. The fuel vapor storage device is also connected to an intake tract of the internal combustion engine via a ventilation valve for the purpose of introducing the stored fuel vapors into the intake valve during a period of tank ventilation. The internal combustion engine also has a controllable valve for adjusting the stream of fuel vapors fed to the intake tract.

According to the method the valve is controlled in such a way that the stream of fuel vapors varies during the tank ventilation period.

In the method known from the prior art a continuous purge stream is passed through the active charcoal bed for the purpose of regenerating the active charcoal. To this end the tank ventilation valve is opened to a maximum degree of opening as quickly as possible. As a result of the intense and continuous percolation of the active charcoal bed, percolation channels form in the active charcoal through which the high speed purge gas stream flows. In the immediate vicinity of the percolation channels the active charcoal is regenerated quickly. However, the zones providing sufficient regeneration are very localized, as the diffusion of fuel vapors from other areas of the active charcoal bed only takes place after a considerable delay. Therefore, if a purge stream is continuous, optimum regeneration of the active charcoal is not possible, with the result that the adsorption capacity of the active charcoal bed can only be partially utilized. Furthermore, the high air mass flow rate in the percolation channels can result in damage to the active charcoal particles in these areas.

According to the method proposed here both the stream of fuel vapors and the purge stream passing through the active charcoal container are varied. This results in the constant formation of new percolation channels, which results in a considerably larger area of the active charcoal bed being percolated with purge gas. Varying the stream of purge gas and the stream of fuel vapors also promotes the diffusion of adsorbed fuel vapors from the periphery to the percolation channels, as a result of which the regeneration of the active charcoal bed becomes considerably more efficient. The better utilization of the adsorption capacity of the active charcoal bed permits considerably greater time intervals between the regeneration phases and a reduction in the volume of the active charcoal container.

In a further embodiment of the method the valve is controlled in such a way that the stream of fuel vapors is reduced and increased again several times during the tank ventilation period.

In a further embodiment of the method, the stream of fuel vapors is reduced until it is completely interrupted. Further embodiments of the method permit the regeneration effect to be increased still further. The repeated reduction or interruption and subsequent increasing of the purge stream passing through the fuel vapor storage device causes the percolation channels to repeatedly re-form and promotes the diffusion of the fuel vapors within the fuel vapor storage device, as a result of which large areas of the fuel vapor storage device are regenerated.

According to a further embodiment, the valve is controlled in such a way that the stream of fuel vapors is increased to a predefined target stream at the beginning of the tank ventilation period and the stream of fuel vapors is not varied until the target stream has been reached.

The initial increase in the stream of fuel vapors to a predefined target stream can for example serve to determine the degree of loading of the fuel vapor storage device. Only thereafter is the stream of fuel vapors varied.

In a further embodiment of the method, the degree of loading of the fuel vapor storage device is determined and the period during which the stream of fuel vapors is reduced is determined as a function of the degree of loading.

According to a further embodiment of the method, the degree of loading of the fuel vapor storage device is determined and the period during which the stream of fuel vapors is reduced is determined as a function of the amount of the maximum stream of fuel vapors.

These embodiments of the method permit increased flexibility in setting the period during which the stream of fuel vapors is reduced, which provides individual adjustment to changing circumstances. Thus it is possible, for example, to increase the period when the degree of loading is small, in order to allow for the lower diffusion speed of the fuel vapors within the fuel vapor storage device. On the other hand, when the amount of the maximum stream of fuel vapors is very large the period can be reduced, as the diffusion speed is higher when this is the case.

In a further embodiment, the valve is a tank ventilation valve that is arranged in the ventilation duct between the fuel vapor storage device and the intake tract.

An internal combustion engine according to an embodiment has a fuel tank and a fuel vapor storage device that is connected, via a ventilation duct, to the fuel tank, for the purpose of storing the fuel vapors escaping therefrom, and which is also connected to an intake tract of the combustion engine via a ventilation duct for the purpose of feeding the stored fuel vapors into the intake tract during a period of tank ventilation. The internal combustion engine also has a controllable valve for adjusting the stream of fuel vapors fed to the intake tract. A control device of the internal combustion engine is connected to the valve and controls it in such a way that the stream of fuel vapors varies during the period of tank ventilation.

The internal combustion engine described is designed in such a way that it can execute the above described methods. The advantages listed in relation to the method apply in the same way to the combustion engine.

FIG. 1 shows an exemplary embodiment of an internal combustion engine 1. The internal combustion engine 1 has at least one cylinder 2 and a piston 3 which can be moved up and down within the cylinder 2. The fresh air required for combustion is introduced via an intake tract 4 into a combustion chamber 5 delimited by the cylinder 2 and the piston 3. An air mass sensor 7 for recording the air mass flow rate in the intake tract 4, a throttle valve 8 to control the air mass flow rate, a suction pipe 9 and an inlet valve 10, by means of which the combustion chamber 5 is connected to or separated from the intake tract 4 as desired, are located downstream from a suction inlet 6 in the intake tract 4.

Combustion is triggered by means of a spark plug 11. The driving power generated by the combustion is transmitted via a drive shaft 12 to the drive train of the vehicle (not shown). A revolution sensor 13 records the number of revolutions made by the internal combustion engine 1.

The combustion exhaust gases are purged via an exhaust gas tract 14 of the internal combustion engine 1. The combustion chamber 5 is connected to the exhaust gas tract 14 via an outlet valve 15 if desired, or can be separated from it. The exhaust gases are purified in an exhaust gas catalytic converter 16. A so-called lambda sensor 17 for measuring the oxygen content of the exhaust gas is also located in the exhaust gas tract 14.

The internal combustion engine 1 also comprises a fuel supply device with a fuel tank 18, a fuel pump 19, a high pressure pump 20, a pressure accumulator 21 and at last one controllable injection valve 22. The fuel tank 18 has a lockable filling nozzle 23 through which it is filled with fuel. The fuel is fed to the injection valve 22 via a fuel supply line 24 by means of the fuel pump 19. The high pressure pump 20 and the pressure accumulator 21 are arranged in the fuel supply line 24. The high pressure pump 20 has the task of delivering the fuel to the pressure accumulator 21 under high pressure. The pressure accumulator 21 is configured as a common pressure accumulator 21 for all injection valves 22. All injection valves 22 are supplied with pressurized fuel via it. The internal combustion engine 1 in the exemplary embodiment is an internal combustion engine with direct fuel injection, a process by which the fuel is injected directly into the combustion chamber 5 by means of the injection valve 22 projecting into the combustion chamber 5. It should however be pointed out that the present invention is not limited to this kind of fuel injection, but can also be applied to other kinds of fuel injection, such as for example intake manifold injection.

The internal combustion engine 1 also has a tank ventilation device. The tank ventilation device possesses a fuel vapor storage device 25, which is configured as an active charcoal container by way of example and is connected to the fuel tank 18 via a connection pipe 26. The fuel vapors produced in the fuel tank 18 are fed into the fuel vapor storage device 25 where they are adsorbed by the active charcoal. The fuel vapor storage device 25 is connected to the suction pipe 9 of the internal combustion engine 1 via a ventilation duct 27. A controllable tank ventilation valve 28, by means of which the stream of fuel vapors can be adjusted, is located in the ventilation duct 27. Furthermore, fresh air can be fed to the fuel vapor storage device 25 via a ventilating duct 29 and a controllable ventilating valve 30 arranged therein.

In certain operating areas of the internal combustion engine 1, particularly when it is idling or running under partial load, the pressure in the suction pipe 9 is much lower then in the area surrounding it as a result of the strong throttling effect caused by the throttle valve 8. Therefore, if the tank ventilation valve and the ventilating valve 30 are opened during a period of tank ventilation, a purging effect results during which the fuel vapors stored in the fuel vapor storage device 25 are fed into the suction pipe 9 and participate in combustion. The fuel vapors thus bring about a change in the composition of the combustion gases and the exhaust gases.

The internal combustion engine 1 is assigned a control device 31 in which engine characteristic-based engine control functions (KF1 to KF5) are implemented by means of software. The control device 31 is connected to all the actuators and sensors of the internal combustion engine 1 via signal lines and data lines. In particular, the control device 31 is connected to the controllable ventilating valve 30, the controllable tank ventilation valve 28, the air mass sensor 7, the controllable throttle valve 8, the injection valve 22, the spark plug 11, the lambda sensor 17 and the revolution sensor 13.

Parts of the internal combustion engine 1 and the control device 31 form a lambda regulating apparatus. The lambda regulating apparatus comprises, in particular, the lambda sensor 17 and a software-implemented lambda regulator 33 in the control device 31, as well as the injection valves 22 and their control circuit, with which the opening times of the injection valves 22 are controlled. The lambda regulating apparatus forms a closed lambda control circuit and is designed in such a way that a variance recorded by the lambda sensor 17 in the composition of the exhaust gases from a predefined lambda target value is corrected by means of an injection quantity adjustment. If the tank ventilation valve 28 is opened during the period of tank ventilation the drop in pressure causes fuel vapors to flow from the fuel vapor storage device 25 into the intake tract 4 and/or the suction pipe 9 of the internal combustion engine 1. These fuel vapors, the concentration of which in the intake air is initially unknown, lead to enrichment of the combustible mixture, i.e. to an excess of hydrocarbons in the combustion gas, and to a corresponding change in the composition of the exhaust gases after combustion. As a result, the lambda value measured by the lambda sensor 17 falls below the target value of, for example Lambda=1. A control deviation thus results, which is recorded by the lambda regulator 33 and corrected by a corresponding change in the starting variable of the regulator. This is achieved by specifying a corresponding correcting variable to the injection valves 22, which causes the quantity of fuel injected to be changed for as long as is required for the malfunction to be corrected. This process is referred to below as injection quantity correction.

To reduce the quantity of harmful substances during the period of tank ventilation, especially at the beginning of the period of tank ventilation, it is necessary for the additional quantity of fuel fed to the combustion chamber 5 as a result of ventilating the tank to be precisely calculated. To this end, the degree to which the fuel vapor storage device 25 is loaded with fuel vapors must be determined. In order to determine the degree of loading, the tank ventilation valve 28 is controlled in such a way that a small but defined flow is established. This can be effected by, for example, a pulse-wide modulated control signal. The change in the combustible mixture thus brought about also leads to a change in the composition of the exhaust gases, which is recorded by the lambda sensor 17 and/or the lambda regulator 33. The opening of the tank ventilation valve 28 leads to a variance in the starting value of the lambda regulator 33 and/or the lambda sensor 17 compared with the point in time before the opening of the tank ventilation valve 28. The difference between the starting value of the lambda regulator 33 and/or the lambda sensor 17 after the opening of the tank ventilation valve 28 and the starting value of the lambda regulator 33 or alternatively of the lambda sensor 17 before the opening of the tank ventilation valve 28 is used to calculate the degree of loading of the fuel vapor storage device 25 by means of a physical model.

Figure 2:
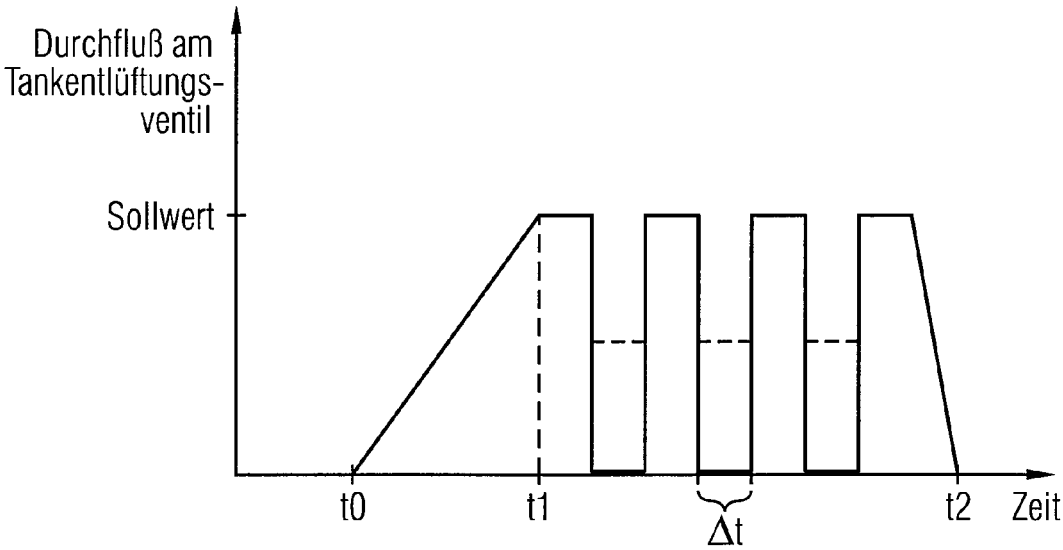
FIG. 2 shows a diagram to illustrate the flow over time at the tank ventilation valve.

A control method for the internal combustion engine 1 will now be explained in more detail with the aid of FIG. 2. In FIG. 2 the flow over time at the tank ventilation valve 28 is schematically represented by way of example. If the conditions for executing regeneration of the fuel vapor storage device 25, such as for example a stationary operating state of the internal combustion engine and sufficient vacuum in the suction pipe, exist, the tank ventilation valve 28 is opened at the point in time t0. As already mentioned above, the degree of opening of the tank ventilation valve 28 for determining the degree of loading of the fuel vapor storage device 25 is slowly increased from point in time t0 until a target value is reached for the stream of fuel vapors at point in time t1. If however the degree of loading is already known from a measurement made shortly beforehand, the tank ventilation valve 28 can also be opened very quickly or suddenly until the target value is reached.

After the target value has been reached the tank ventilation valve 28 is controlled in such a way that the stream of fuel vapors is reduced several times in succession and increased again to the target value. This is effected by controlled opening and closing of the tank ventilation valve 28. At the tank ventilation valve 28 the stream of fuel vapors can either be reduced by only a certain amount or be completely stopped. In FIG. 2 the two alternatives are represented by a dotted line and a continuous line.

The period of time $\Delta t$ during which the flow at the tank ventilation valve is reduced or interrupted can be determined here by the control device 31 as a function of the calculated degree of loading or of the amount of the maximum flow at the tank ventilation valve 28. If for example the degree of loading or the maximum flow is very small the time span $\Delta t$ is increased. This permits the lower diffusion speed of the fuel vapors to be better allowed for. After repeated opening and closing of the tank ventilation valve 28 the tank ventilation valve 28 is completely closed until point in time t2. The tank ventilation period is therefore delimited by the points in time t0 and t2.

Varying the stream of fuel vapors at the tank ventilation valve 28 causes the constant formation of new percolation channels in the active charcoal bed of the fuel vapor storage device 25. Better blending of the active charcoal also results, which promotes the diffusion of the fuel vapors from less percolated areas to the percolation channels and thus the regeneration of the fuel vapor storage device 25. As a result of the improved regeneration, the adsorption capacity of the fuel vapor storage device 25 can subsequently be better utilized and it is also possible to reduce the total volume of the fuel vapor storage device 25.

What is claimed is:

1. A method for controlling an internal combustion engine wherein a fuel vapor storage device is connected to a fuel tank via a connection pipe for the purpose of storing the fuel vapors escaping therefrom, as well as to an intake tract of the internal combustion engine, via a ventilation duct, for the purpose of introducing the stored fuel vapors into the intake tract during a period of tank ventilation, and wherein a controllable valve for adjusting the stream of fuel vapors fed to the intake tract is provided, the method comprising the step of:

controlling the valve in such a way that the stream of fuel vapors varies during the tank ventilation period, including:

controlling the valve to initiate an initial increase in the stream of fuel vapors to a predefined target stream;

based on the initial increase in the stream of fuel vapors, determining a degree of loading of the fuel vapor storage device;

calculating a stream reduction time period based on the determined degree of loading of the fuel vapor storage device;

after the initial increase in the stream of fuel vapors reaches the predefined target stream, controlling the valve to implement a series of multiple successive fuel vapor stream reductions and increases, each fuel vapor stream reduction reducing the stream below the predefined target stream and each fuel vapor stream increase increasing the stream to the predefined target stream;

wherein at least one of the fuel vapor stream reductions is implemented for a duration equal to the calculated stream reduction time period; and after the series of multiple successive fuel vapor stream reductions and increases, completely closing the controllable valve.

2. The method according to claim 1, wherein the valve is controlled in such a way that the stream of fuel vapors is increased to a predefined target stream at the beginning of the tank ventilation period and the stream of fuel vapors is not varied until the target stream has been reached.

3. The method according to claim 1, wherein the valve is a tank ventilation valve that is arranged in the ventilation duct between the fuel vapor storage device and the intake tract.

4. An internal combustion engine comprising:

a fuel tank, a fuel vapor storage device, which is connected to the fuel tank via a connection pipe for the purpose of storing the fuel vapors escaping therefrom, as well as to an intake tract of the internal combustion engine, via a ventilation duct, for the purpose of introducing the stored fuel vapors into the intake tract during a period of tank ventilation, a controllable valve for adjusting the stream of fuel vapors fed to the intake tract, a control device, which is connected to the valve and which controls the valve in such a way that the stream of fuel vapors varies during the tank ventilation period, the control device operable to control the valve by:

controlling the valve to initiate an initial increase in the stream of fuel vapors to a predefined target stream;

based on the initial increase in the stream of fuel vapors, determining a degree of loading of the fuel vapor storage device;

calculating a stream reduction time period based on the determined degree of loading of the fuel vapor storage device;

after the initial increase in the stream of fuel vapors reaches the predefined target stream, controlling the valve to implement a series of multiple successive fuel vapor stream reductions and increases, each fuel vapor stream reduction reducing the stream below the predefined target stream and each fuel vapor stream increase increasing the stream to the predefined target stream;

wherein at least one of the fuel vapor stream reductions is implemented for a duration equal to the calculated stream reduction time period; and after the series of multiple successive fuel vapor stream reductions and increases, completely closing the controllable valve.

5. The internal combustion engine according to claim 4, wherein the valve is controlled in such a way that the stream of fuel vapors is increased to a predefined target stream at the beginning of the tank ventilation period and the stream of fuel vapors is not varied until the target stream has been reached.

6. The internal combustion engine according to claim 4, wherein the valve is a tank ventilation valve that is arranged in the ventilation duct between the fuel vapor storage device and the intake tract.

7. A method for controlling an internal combustion engine comprising the steps of:

connecting a fuel vapor storage device to a fuel tank via a connection pipe for the purpose of storing the fuel vapors escaping therefrom, as well as to an intake tract of the internal combustion engine, via a ventilation duct, for the purpose of introducing the stored fuel vapors into the intake tract during a period of tank ventilation, and controlling a controllable valve for adjusting the stream of fuel vapors fed to the intake tract in such a way that the stream of fuel vapors varies during the tank ventilation period, including:

controlling the valve to initiate an initial increase in the stream of fuel vapors to a predefined target stream;

based on the initial increase in the stream of fuel vapors, determining a degree of loading of the fuel vapor storage device;

calculating a stream reduction time period based on the determined degree of loading of the fuel vapor storage device;

after the initial increase in the stream of fuel vapors reaches the predefined target stream, controlling the valve to implement a series of multiple successive fuel vapor stream reductions and increases, each fuel vapor stream reduction reducing the stream below the predefined target stream and each fuel vapor stream increase increasing the stream to the predefined target stream;

wherein at least one of the fuel vapor stream reductions is implemented for a duration equal to the calculated stream reduction time period; and after the series of multiple successive fuel vapor stream reductions and increases, completely closing the controllable valve.

8. The method according to claim 7, wherein the valve is controlled in such a way that the stream of fuel vapors is increased to a predefined target stream at the beginning of the tank ventilation period and the stream of fuel vapors is not varied until the target stream has been reached.

* * * * *